US007652429B2

(12) United States Patent
Maya

(10) Patent No.: US 7,652,429 B2
(45) Date of Patent: Jan. 26, 2010

(54) ELECTRODES WITH CERMETS FOR CERAMIC METAL HALIDE LAMPS

(75) Inventor: Jakob Maya, Brookline, MA (US)

(73) Assignee: Resat Corporation, Brookline, MA (US)

( * ) Notice: Subject to any disclaimer, the term of this patent is extended or adjusted under 35 U.S.C. 154(b) by 360 days.

(21) Appl. No.: 11/710,882

(22) Filed: Feb. 26, 2007

(65) Prior Publication Data

US 2008/0203917 A1 Aug. 28, 2008

(51) Int. Cl.
*H01J 17/18* (2006.01)

(52) U.S. Cl. ..... 313/625; 313/623

(58) Field of Classification Search ..... 313/623–625
See application file for complete search history.

(56) References Cited

U.S. PATENT DOCUMENTS

| | | | | |
|---|---|---|---|---|
| 4,155,757 | A | 5/1979 | Hing | |
| 4,808,882 | A | 2/1989 | Parker et al. | |
| 4,910,432 | A | 3/1990 | Brown et al. | |
| 5,099,174 | A | 3/1992 | Coxon et al. | |
| 5,404,078 | A | 4/1995 | Bunk et al. | |
| 5,424,609 | A | 6/1995 | Geven et al. | |
| 6,139,386 | A | 10/2000 | Suzuki et al. | |
| 6,495,959 | B1 * | 12/2002 | Ikeuchi et al. | 313/623 |
| 6,750,611 | B2 | 6/2004 | Gubbels | |
| 6,856,079 | B1 * | 2/2005 | Zhu | 313/326 |
| 6,882,109 | B2 | 4/2005 | Nakano et al. | |
| 7,122,953 | B2 | 10/2006 | Piena | |
| 2003/0234612 | A1 * | 12/2003 | Kelly et al. | 313/623 |
| 2006/0001380 | A1 * | 1/2006 | Brates et al. | 313/624 |

* cited by examiner

*Primary Examiner*—Joseph L Williams
(74) *Attorney, Agent, or Firm*—Jakob Maya

(57) ABSTRACT

This invention is about a CMH lamp arc tube seal construction where the feedthrough electrode contains a cermet in such a manner that the said cermet is either not exposed outside the ceramic capillary (which in most cases is polycrystalline alumina, PCA) or if it is exposed to the outside of the arc tube, the part that is exposed has no current carrying function. The invention provides safe ways of assembling the cermet so as to avoid breakage of the said cermet due to mechanical stresses in the electrical connections.

21 Claims, 4 Drawing Sheets

ELECTRODES WITH CERMETS FOR CERAMIC METAL HALIDE LAMPS

BACKGROUND OF THE INVENTION

This invention is about Ceramic Metal Halide lamps (CMH) and the sealing technology of such lamps.

Often times one of the components in the electrode feedthrough of such lamps is made of a cermet material. Cermets have been known for a long time to provide acceptable solutions for the sealing of electrical feedthroughs to surrounding nonconductive materials. For example cermet materials have been made as early as 1979 by mixing course refractory oxide granules with fine metallic powders, such as tungsten, nickel and molybdenum to obtain electrical conductivity and yet a thermal expansion coefficients compatible with ceramic materials.

In later years, up to the early 1990's, the details of making the cermets with various particle size materials, their construction forms and their initial use in ceramic metal halide lamps were described by various lamp developers, but did not yet result in a practical ceramic metal halide lamp. Later on in the mid 1990's the first commercially viable CMH lamp was introduced and the whole field of metal halide lamps got a big boost as a result since the color characteristics, the kind of chemistries that one could use and the efficacies obtained were far superior to the quartz metal halide technology. While the initial lamps introduced had an electrode construction made out of Nb, Mo and W metals later CMH lamp introductions used cermets quite frequently. Much of the work attempted to either shorten the overall size of the extended plug construction, lower the cost of the materials used, increase reliability of the seal under high temperature conditions or provide an alternative seal that may be more manufacturable or some combination of these. In many of the cermet constructions the brittleness of the cermet is still an issue and needs to be solved.

BRIEF SUMMARY OF THE INVENTION

This invention is about a CMH lamp arc tube seal construction where the feedthrough electrode contains a cermet in such a manner that the said cermet is either not exposed outside the ceramic capillary (which in most cases is polycrystalline alumina, PCA) or if it is exposed to the outside of the arc tube, the part that is exposed has no current carrying function. The invention provides safe ways of assembling the cermet so as to avoid breakage of the said cermet due to mechanical stresses in the electrical connections. The need for protecting the cermet arises due to its brittle nature and its susceptibility to mechanical stress. In the majority of the embodiments described the cermet is protected by the PCA capillary completely surrounding it. In a few embodiments the cermet extends to the outside of the capillary and beyond the frit fillet; however in those cases the part of the cermet that is likely to break off has no current carrying function such that electrical continuity is maintained in spite of the break.

DETAILED DESCRIPTION

Figure 1:
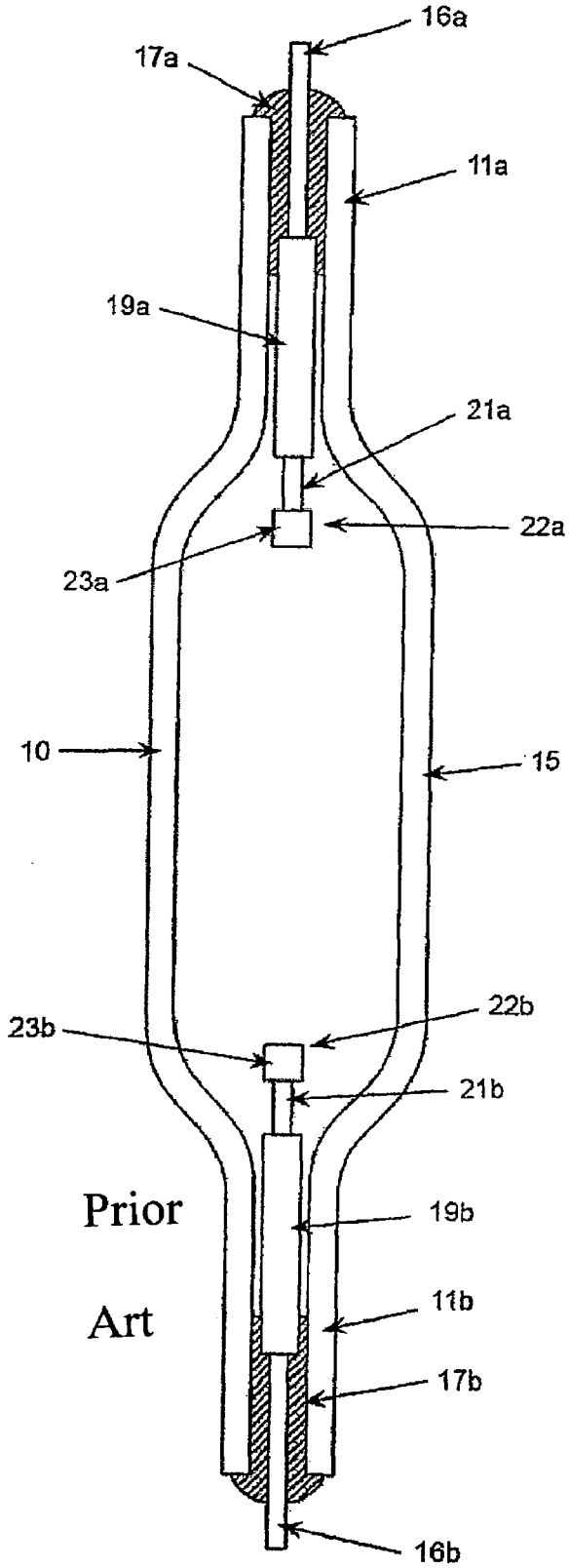
FIG. 1 shows a cross section of a known extended plug construction for a CMH arc tube.

As is well known the extended plug construction of such lamps as shown in FIG. 1 allows the seal temperature to be considerably lower than a non-extended plug construction. The reason for this is the fact that the extended plug construction removes the seal further from the electrode which is the heat source, compared to the non-extended plug that happens to have the seal very close to the electrode and the main chamber of the discharge (essentially without a capillary PCA extension) close to the electrode. This feature enables these types of lamps to have a reasonable lifetime and be commercially viable. One of the construction techniques provides the use of cermets (ceramic-metal composites) that have an expansion coefficient intermediary to the two joining materials (which provide for the cermet)—most often polycrystalline alumina (PCA) and molybdenum (Mo). In as much as the cermet successfully provides a hermetic seal between the electrode and the PCA of the capillary tube via the frit material, it tends to be fairly brittle and hard to spot weld to. Therefore it is quite a task to handle the leads with an exposed cermet piece sticking out of the PCA capillary.

The current invention disclosure addresses this particular issue and provides acceptable technical and economical solutions which are superior to the existing approaches as can be seen in the following paragraphs.

As mentioned above cermets do provide a good solution for an electrically conductive and yet thermal expansion wise compatible structure for CMH lamps. However, as mentioned above the brittleness of the cermets and the difficulty of spot welding to them, make them a difficult choice in manufacturing unless a suitable solution is found that attaches the cermets to an electrical conductor.

The present invention is an improvement over the arc tube whose cross section is shown in FIG. 1. This is an arc tube of a 150 W ceramic metal halide lamp that uses an extended plug construction. Here a discharge tube 10 includes a cylindrical main tube 15 smoothly joined with tapered capillaries 11*a* and 11*b*. The main tube 15 as well as the capillary part of the main tube 11*a* and 11*b* may be made of translucent ceramic material in which alumina is a main component. Sealing member 16*a*, a first lead-through wire 19*a* and a first main electrode shaft 21*a* are integrated and inserted in tube 11*a*. Specifically one end of lead-through-wire 19*a* is connected with one end of sealing member 16*a* by welding, and the other end of lead-through-wire 19*a* is connected with one end of main electrode shaft 21*a* by welding. Then sealing member 16*a* is fixed to the inner surface of tube 11*a* by a frit 17*a* such that tube 11*a* is sealed hermetically. When sealing member 16*a* first lead-through-wire 19*a* and first main electrode shaft 21*a* are disposed in the tube 11*a*, an end of sealing member 16*a* may be positioned outside tube 11*a* as described in the various embodiments of the invention. An electrode coil 22*a* is integrated and mounted to the tip portion of main electrode shaft 21*a* by welding, so that main electrode 23*a* includes main electrode shaft 21*a* and electrode coil 22*a*. The lead-through-wire 19*a* serves as a lead-through for positioning the main electrode 23*a* at a predetermined position in main tube 15. The sealing member 16*a* is typically formed by a metal wire compatible with the frit expansion coefficient. For example the diameter of the sealing member 16*a* may be 0.9 mm and the diameter of the first main electrode shaft may be 0.5 mm.

Figure 1A:
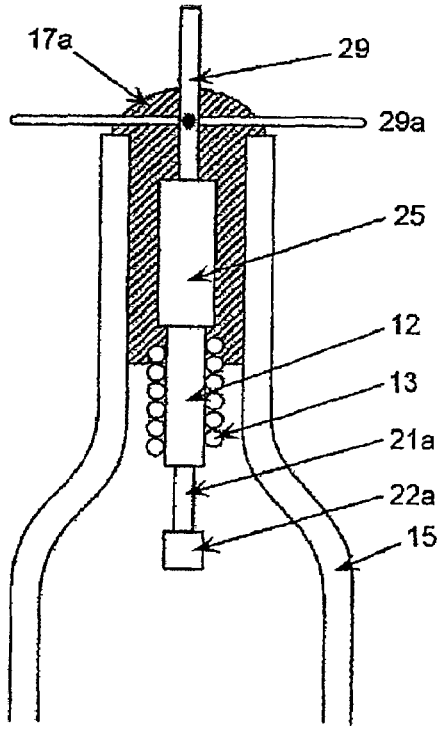
FIG. 1*a* shows a one side cross section of a known extended plug construction for a CMH arc tube.

An alternative to the FIG. 1 construction is shown in FIG. 1*a* where the cross section of one side of the PCA capillary is shown. Here instead of attaching the cermet 25 directly to the W pin 21*a* one inserts a Mo or W mandrel 12 and a fine Mo coil 13 surrounding the mandrel between the cermet and the W pin. The advantage of this construction, described in prior art, is the fact that the salts do not penetrate as far into the end of the capillary and therefore they are not as cold, thereby, yielding reasonable performance of the light source. In addition the combination of the Mo or W mandrel and Mo coil is compatible with the expansion/contraction of the capillary PCA so as not to lead to cracking.

In the following FIGS. 2-11 we show the different designs of the extended plug invention which basically change the structures of items 16-22 *a* and *b*. In all cases the cermet is composed of a metal such as Mo (unless specified as Nb or Mo—Nb) and aluminum oxide powder while the frit is composed of oxides of Al—Dy—Si in a variety of proportions. A cermet composed of 2 or 3 different metals and PCA powder is within the scope of the invention and applies to all the different designs. In addition all the designs we describe below can have portions other than the electrodes with the cermet material and the seal thereabout with the construction of similar portions of either FIG. 1 or FIG. 1*a*.

Figure 2:
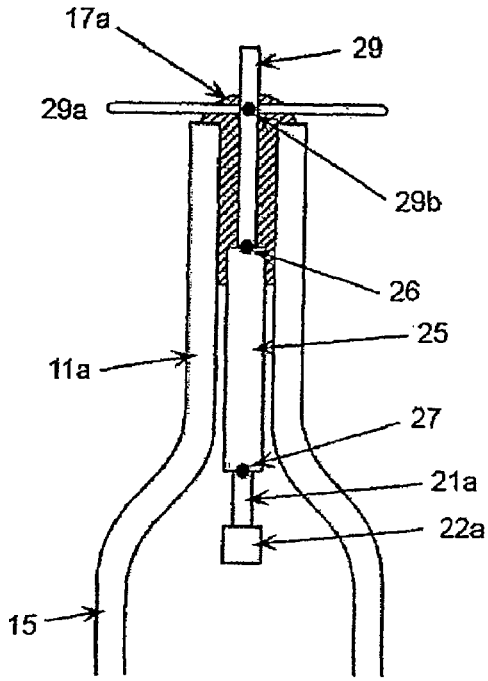
FIG. 2 shows a one side cross section of a plug construction embodying the present invention.

FIG. 2 shows a cross section of a design where the cermet's 25 integrity is protected by keeping it inside the PCA capillary 11*a* and welding (most conveniently by using a laser) a Mo pin 29 to the end of the cermet protruding to the outside of the capillary so that the current can be transferred from a power source to the tip of the electrode and then to the gaseous discharge. This electrode construction requires two laser welds 26 and 27 one at each end of the cermet and the whole structure is prepared ahead of time before inserting it into the arc tube. Typically some cross wire 29*a* is inserted perpendicular to the Mo pin and just above the capillary PCA 11*a* edge so as to make sure that the electrode does not fall through the capillary opening to the inside of the arc tube. In other words the cross wire basically stops the electrode at the right length. The cross wire most conveniently may be spot welded to the Mo pin as 29*b*. The material of this cross wire could be either Mo, Nb, Ta, Ti or other not limited by these choices. Since the frit material 17*a* typically bonds to the cermet and the PCA well; hermeticity can be accomplished during the thermal cycling when the lamp is in use. This approach while protecting the integrity of the cermet will provide a conduit for the current via the Mo pin-cermet-W coil electrode construction.

Figure 3:
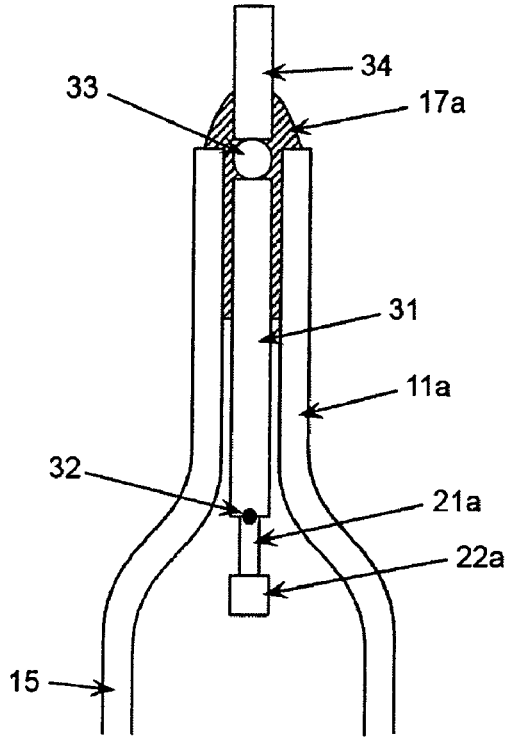
FIG. 3 shows a one side cross section of another plug construction embodying the present invention.

FIG. 3 shows a cross section view in which the cermet 31 is still kept inside the PCA capillary 11*a* of the arc tube while the external lead is made out of Nb 34 and the interface of the cermet 31 and the Nb lead 34 (which lead is outside the capillary) is provided by a bead of Mo 33. The advantages of this approach are as follows: The frit material 17*a* wets the external lead Nb well and as such the seal outside the capillary is likely to be very sturdy. The small Mo stub 33, which can be a small cylinder cut out of Mo wire, inside the capillary is a good transition from the Mo—PCA cermet to Nb and as such does not experience as much stress as the direct seal without the Mo stub during expansion and contraction cycles due to thermal cycling in ordinary use of the lamp. A typical size of the Mo part in the electrode construction would be no more than a tenth of the total length of the electrode. This would easily be welded to the Nb and the cermet with one operation of the laser welder which is done as a separate operation before the assembly of the arc tube.

Figure 4:
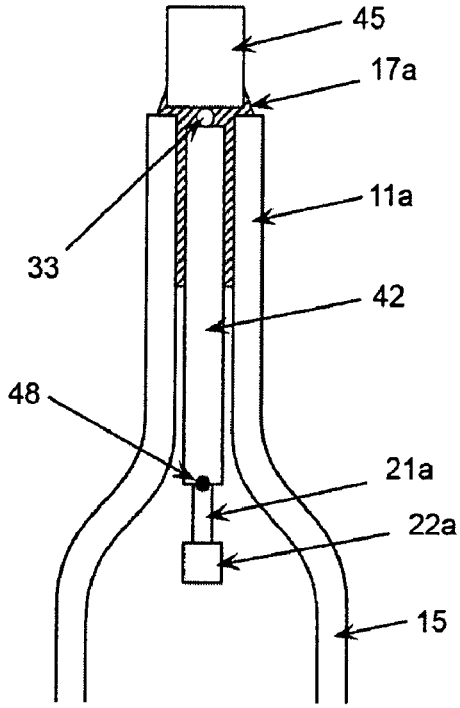
FIG. 4 shows a one side cross section of yet another plug construction embodying the present invention.

FIG. 4 shows another embodiment of the same concept whereby the size of the Nb pin 45 is larger than the Mo diameter 46 or the cermet 42 by at least a factor of two. This difference in diameters provides for a stopping point of the electrode so that one need not worry about how to stop the electrode from falling into the arc tube through the capillary or the use of a wire to mark the stopping point of the electrode. The Mo stub 33, the Nb 45 and the cermet 42 can most conveniently be laser welded in one operation. Similarly, the cermet 42 can be conveniently welded with a laser to the W pin 21*a*. Otherwise the advantages of this approach are the same as mentioned above in connection with FIG. 3.

Figure 5:
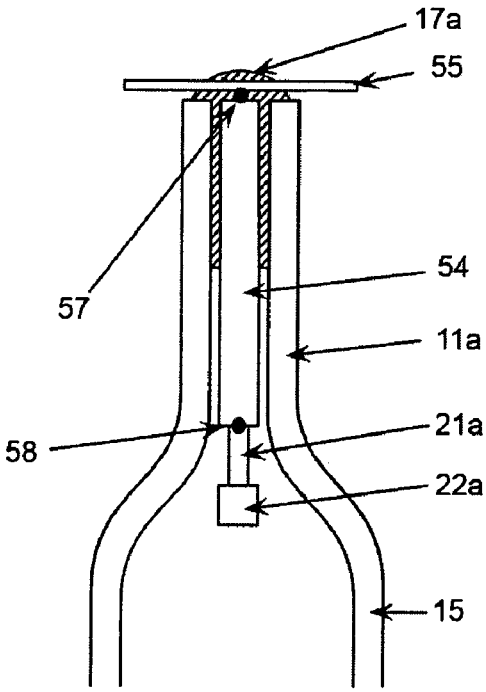
FIG. 5 shows a one side cross section of still another plug construction embodying the present invention.
Figure 6:
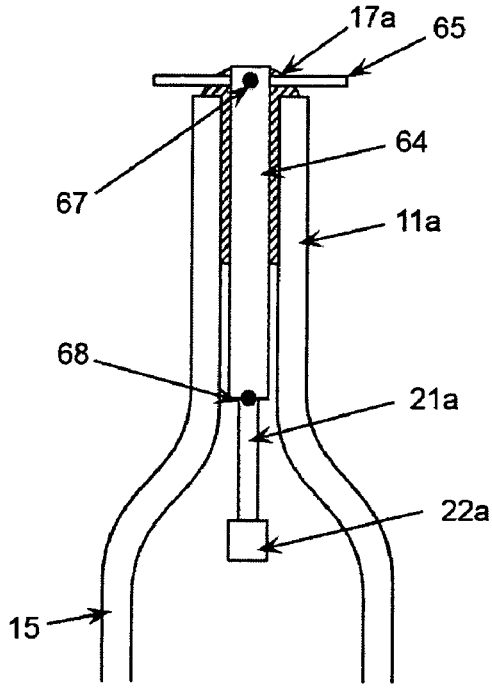
FIG. 6 shows a one side cross section of a different plug construction embodying the present invention.

FIGS. 5 and 6 show two different designs of the idea of using a cermet 54 made out of PCA and Nb, or PCA—Nb—Mo combination such that the volume percentage of metals versus the total is no more than about 50%. This particular combination of materials in the cermet tends to have a stronger and better binding to the frit and thereby PCA than just Mo. While some of this can be explained by the expansion coefficient of Nb the rest has to do with the physicochemical properties of the metal and the frit material 17*a* (composed typically of the oxides of Al, Si and Dy). The difference between FIGS. 5 and 6 is essentially the length of the cermet rod where in FIG. 5 the rod ends at the edge of the PCA capillary 11*a* while in FIG. 6 it extends beyond the edge of the PCA capillary up to the top of the frit fillet 17*a*. The FIG. 5 design we believe will give a somewhat sturdier protection to the cermet while the FIG. 6 design will have a more practical advantage of providing a larger piece of the cermet to weld onto. The choice between these two designs might depend on the power level of the lamp which would have different diameter cermet rods. The FIG. 5 design would be preferred for the lower power lamps with a smaller diameter cermet rod while FIG. 6 design would be preferable for the higher power lamps. Again the different pieces are welded as shown in FIG. 5 by laser welds 57 and 58 and in FIG. 6 by laser welds 67 and 68. The cross wires 55 and 65 in FIGS. 5 and 6 respectively may be made out of a material compatible with the frit expansion coefficient such as Nb, Mo etc.

Figure 7:
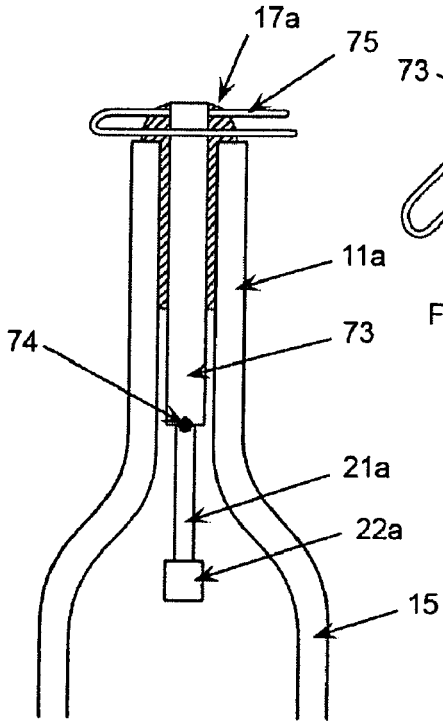
FIG. 7 shows a one side cross section of still a different plug construction embodying the present invention.
Figure 7A:
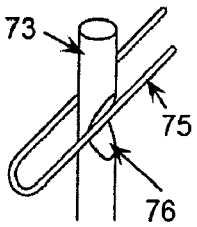
FIG. 7*a* shows a detail of the FIG. 7 embodiment.

Another embodiment of attaching the cermet to an electrical conductor in a safe manner such that the brittleness of the cermet is not a problem is shown in FIG. 7. Here the cermet 73 has a horizontal groove 76 on the part external to the capillary 11*a* such that a tight Nb or Mo (or some other metal compatible with the frit composition) hairpin ("U" shape) 75 holds the cermet in place and from falling into the capillary 11*a* of the arc tube. This horizontal hairpin is preferably made out of Nb metal and sits outside the capillary, in fact on top of it holding the cermet mechanically. The cermet could have a small groove to accommodate the hairpin which is acting both as stop wire as well as conducting current to the cermet and holding it in place at the right distance while the frit 17*a* is being melted during processing. When the frit melts it binds the cermet and the PCA and the hairpin altogether hermetically. The basic idea here is the use of a metal hairpin or some other shape and hold the cermet mechanically until the frit melts and binds the pieces together permanently allowing for the current source to be connected to the hairpin without experiencing the brittleness of the cermet or mechanically stressing it. The reason the cermet's brittleness is not an issue anymore is because the cermet is buried inside the frit and is not susceptible to much direct mechanical stress. FIG. 7*a* shows more detail of the hairpin-cermet arrangement. The electrode of FIG. 7 requires only one weld resulting in a lower cost electrode.

Figure 8:
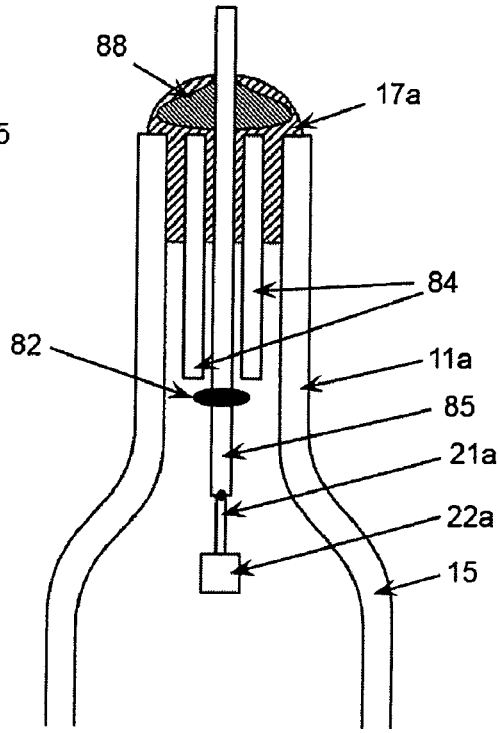
FIG. 8 shows a one side cross section of yet a different plug construction embodying the present invention.

Yet another embodiment of the present invention is shown in FIG. 8 where the cermet 84 is made into a hollow cylinder rather than a solid one. This geometry of the cermet allows the use of a metallic pin of say Mo 85 to go through the opening of the cermet and carry the current to the tungsten pin 21*a* and tungsten coil 22*a* for the electrical discharge to take place. We should reiterate here that the cermet provides a better seal to the PCA capillary 11*a* via the frit material 17*a* rather than Mo alone and as such it is still a necessary and preferred material to use. A further advantage is that a single piece of Mo metal is all is needed to attach to the tungsten (W) pin 21*a* and W coil 22*a* and as such it offers a more economical solution to the entire electrode construction. Clearly either a cross wire or a flattened part on the Mo wire 88 would be needed to prevent the pin from falling through during the sealing process. Flattening of the Mo wire can be accomplished with a simple squeeze of the wire at the right place using a pair of pliers. This will distort the circular cross section of the wire and make it impossible to go through the tight opening of the PCA capillary. A slight flattening at 82 prevents the cermet from falling through while a larger flattening at 88 prevents the whole assembly from falling through the capillary 11*a*.

Figure 9:
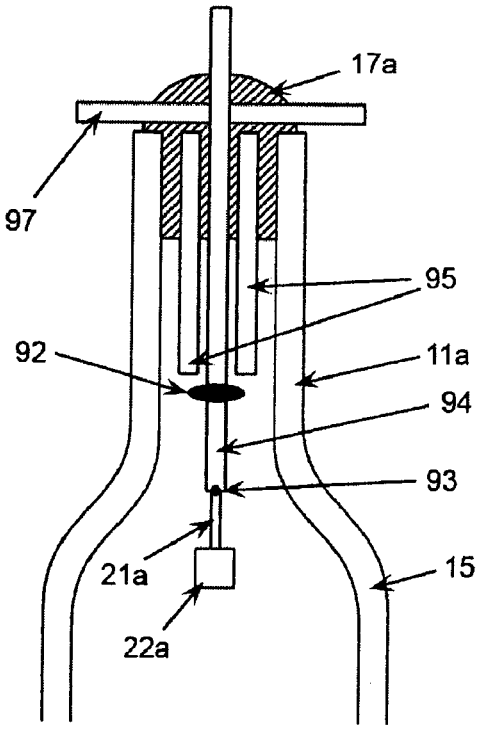
FIG. 9 shows a one side cross section of yet another plug construction embodying the present invention.

It is also conceivable to have the part of the pin sticking out of the capillary and the cross wire 97 both made out of Nb instead of Mo as shown in FIG. 9 since Nb tends to stick better to the frit material and provides somewhat better bonding. The cross wire, of course is simply spot welded to the vertical pin made out of Mo. The cermet again is held in place by the slight flattening of the pin as shown in 92.

Figure 10:
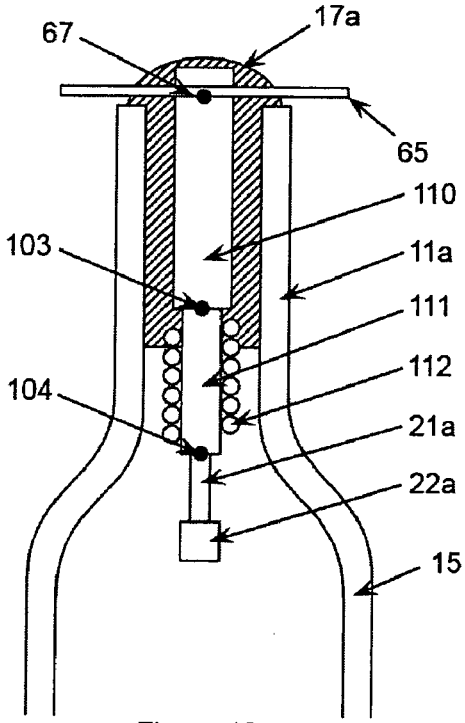
FIG. 10 shows a one side cross section of a different plug construction embodying the present invention.

In FIG. 10 we show a one side cross section of the designs of FIGS. 5 and 6 with the exception that the end of the cermet closer to the W electrode has the Mo mandrel/Mo coil combination of FIG. 1*a* as a construct instead of directly attaching to the W pin/W coil combination as shown in FIGS. 5 and 6.

Figure 11A:
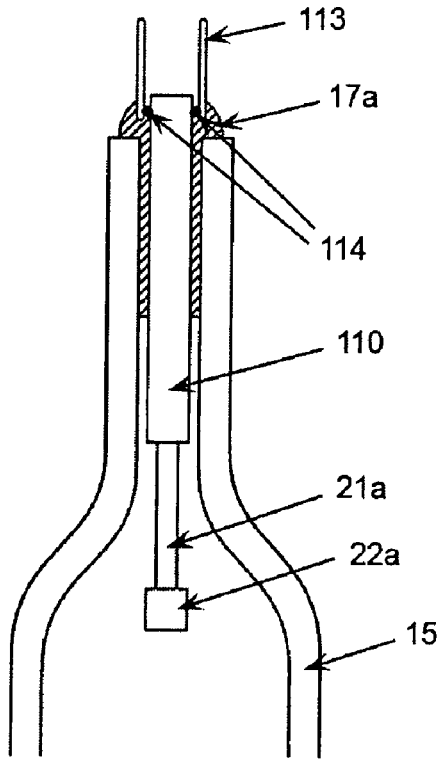
FIGS. 11*a* and 11*b* show one side cross-section of two additional plug constructions embodying the present invention.
Figure 11B:
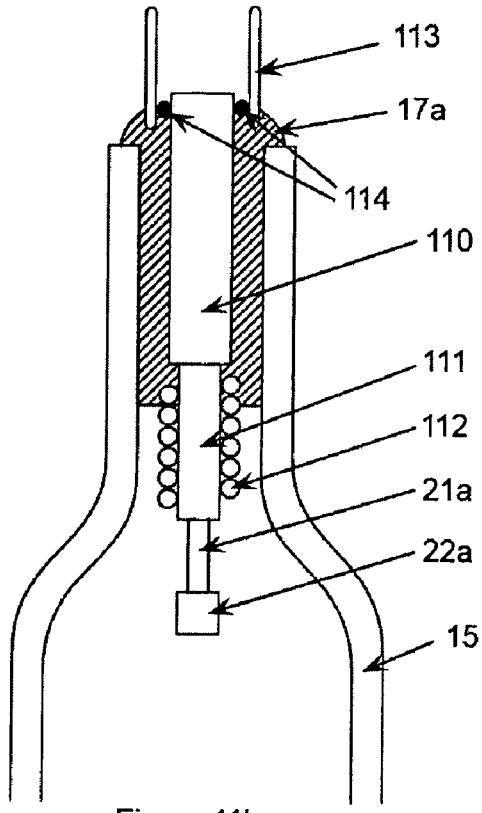

In FIG. 11*a* we show yet another embodiment of the invention where the cermet 110 is protected from breakage by a hollow tube 113 made out of a metal compatible with the frit and the cermet expansion coefficients. This metal could be made out of Mo, Nb or some other metal. The hollow tube 113 is either spot welded or laser welded, as shown in 114, to the cermet ahead of time before the entire feedthrough is inserted into the capillary. If the cermet is laser welded to the hollow tube hermetically the frit during processing will not penetrate into the hollow tube, it will simply seal the cermet/hollow tube combination to the capillary. If, however, the cermet is spot welded to the hollow tube non-hermetically, then the frit will penetrate into the inside of the hollow tube and provide an additional sealing of the cermet/hollow tube combination. The advantage of the FIG. 11*a* construction is the fact that the hollow tube metal's expansion coefficient does not have to be compatible with the PCA capillary material since it is not in contact with the PCA. This results in more choices for the hollow tube material. A similar construction is shown in FIG. 11*b* where the end of the cermet closest to the gas discharge inside the arc tube is terminated by a Mo or W mandrel 111 and Mo coil 112 as an alternate construction explained above.

Although the present invention has been described with reference to preferred embodiments, workers skilled in the art will recognize that changes may be made in form and detail without departing from the spirit and scope of the invention.

The invention claimed is:

1. An arc discharge metal halide lamp for providing visible light, the lamp comprising:

an arc discharge vessel formed of a visible light transmissive structure which defines a discharge region containing ionizable materials including a metal halide material and which has capillary tubes therein with first and second electrodes each extending through an interior passageway from a tube outer end in a corresponding one of the capillary tubes to have an interior end of that electrode positioned opposite the interior end of the other in the discharge region and an exterior end thereof positioned outside the outer end of that capillary tube; and at least one of the electrodes having an exterior end structure part therein affixed to a cermet material part therein that is free of any portion thereof extending out of the corresponding capillary tube past the outer tube end and having the outer electrode part free of any portion thereof being within this corresponding capillary tube.

2. The lamp of claim 1 wherein the cermet material is part of the electrode and is electrically connected therein between the interior and exterior ends thereof.

3. The lamp of claim 2 wherein the electrode has the interior end thereof formed of a metal interior end structure and has the exterior end thereof formed of a metal exterior end structure with the interior end and exterior end structures being electrically connected to one another at least in part by the cermet material electrically connected therebetween.

4. The lamp of claim 3 wherein the cermet material is positioned within the interior passageway of the capillary tube at or interior to the outer end of that capillary tube and is at least partially covered by a flit material extending into the interior passageway.

5. The lamp of claim 4 wherein the metal exterior end structure is a molybdenum rod welded to the cermet material.

6. The lamp of claim 4 wherein the metal exterior end structure is a niobium rod welded to a shorter molybdenum rod which is welded to the cermet material.

7. The lamp of claim 4 wherein the metal exterior end structure is a niobium rod positioned across the outer end of the capillary tube which rod is welded to the cermet material.

8. The lamp of claim 4 wherein the metal exterior end structure is a niobium rod having a cross section extent in at least one direction which is greater than a cross section extent of the capillary tube interior passageway and which rod is welded to the cermet material.

9. An arc discharge metal halide lamp for providing visible light, the lamp comprising:

an arc discharge vessel formed of a visible light transmissive structure which defines a discharge region containing ionizable materials including a metal halide material and which has capillary tubes therein with first and second electrodes each extending through an interior passageway from a tube outer end in a corresponding one of the capillary tubes to have an interior end of that electrode positioned opposite the interior end of the other in the discharge region and an exterior end thereof positioned outside the outer end of that capillary tube;

at least one of the electrodes has the interior end thereof formed of a metal interior end structure and has the exterior end thereof formed of a metal exterior end structure with the interior end and exterior end structures being electrically connected to one another at least in part by a cermet material electrically connected therebetween with the cermet material positioned within the interior passageway of the capillary tube to have at least a portion thereof exterior to the outer tube end of that capillary tube that is at least partially covered by a directly contacting flit material that also extends into the interior passageway.

10. The lamp of claim 9 wherein the metal exterior end structure is a niobium rod positioned across the outer end of the capillary tube which rod is welded to the cermet material.

11. The lamp of claim 9 wherein the metal exterior end structure is a niobium clip having two side members resiliently joined together at one end of each and positioned across the outer end of the capillary tube, the portion of the cermet material exterior to the outer end of the capillary tube having a groove therein with the clip side members positioned on either side thereof with one side member in the groove.

12. The lamp of claim 1 wherein the cermet material is formed as a truncated cylindrical shell positioned surrounding a portion of the electrode.

13. The lamp of claim 12 wherein the electrode has the interior end thereof formed of a metal interior end structure and has the exterior end thereof formed of a metal exterior end structure that are electrically connected to one another with the exterior end structure having at least a portion thereof surrounded by the cermet material truncated cylindrical shell.

14. The lamp of claim 13 wherein the cermet material is positioned within the interior passageway of the capillary tube at or interior to the outer end of that capillary tube and is at least partially covered by a flit material extending into the interior passageway.

15. The lamp of claim 14 wherein the metal exterior end structure is a molybdenum rod welded to the metal interior end structure.

16. The lamp of claim 15 wherein the metal exterior end structure includes a niobium rod positioned across the outer end of the capillary tube which rod is welded to the molybdenum rod.

17. The lamp of claim 1 wherein the cermet material comprises alumina and molybdenum.

18. The lamp of claim 1 wherein the cermet material comprises alumina and niobium.

19. The lamp of claim 1 wherein the cermet material comprises alumina, niobium and molybdenum.

20. An arc discharge metal halide lamp for providing visible light, the lamp comprising:

an arc discharge vessel formed of a visible light transmissive structure which defines a discharge region containing ionizable materials including a metal halide material and which has capillary tubes therein with first and second electrodes each extending through an interior passageway from a tube outer end in a corresponding one of the capillary tubes to have an interior end of that electrode positioned opposite the interior end of the other in the discharge region and an exterior end thereof positioned outside the outer end of that capillary tube; and at least one of the electrodes having a cermet material therewith, free of any portion thereof for conducting electrical current between the first and second electrodes, also being free of any portion thereof extending out of the corresponding capillary tube past the outer tube end.

21. An arc discharge metal halide lamp for providing visible light, the lamp comprising:

an arc discharge vessel formed of a visible light transmissive structure which defines a discharge region containing ionizable materials including a metal halide material and which has capillary tubes therein with first and second electrodes each extending through an interior passageway from a tube outer end in a corresponding one of the capillary tubes to have an interior end of that electrode positioned opposite the interior end of the other in the discharge region and an exterior end thereof positioned outside the outer end of that capillary tube; and at least one of the electrodes has the interior end thereof formed of a metal interior end structure and has the exterior end thereof formed of a metal exterior end structure with the interior end and exterior end structures being electrically connected to one another at least in part by a cermet material electrically connected therebetween with the cermet material positioned within the interior passageway of the capillary tube to have at least a portion thereof exterior to the outer tube end of that capillary tube that is at least partially covered by a flit material extending into the interior passageway, the metal exterior end structure being a niobium clip having two side members resiliently joined together at one end of each and positioned across the outer end of the capillary tube, the portion of the cermet material exterior to the outer end of the capillary tube having a groove therein with the clip side members positioned on either side thereof with one side member in the groove.

* * * * *